US009331421B2

(12) United States Patent
Lai

(10) Patent No.: US 9,331,421 B2
(45) Date of Patent: May 3, 2016

(54) WATERPROOF ELECTRIC CONNECTOR MODULE AND ITS WATERPROOF HOUSING

(71) Applicant: JESS-LINK PRODUCTS CO., LTD., New Taipei (TW)

(72) Inventor: Cheng-Chung Lai, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 0 days.

(21) Appl. No.: 14/632,667

(22) Filed: Feb. 26, 2015

(65) Prior Publication Data

US 2016/0093974 A1 Mar. 31, 2016

(30) Foreign Application Priority Data

Sep. 26, 2014 (TW) ..... 103217112 U

(51) Int. Cl.
*H01R 13/52* (2006.01)
*H01R 13/405* (2006.01)

(52) U.S. Cl.
CPC ..... *H01R 13/5202* (2013.01); *H01R 13/405* (2013.01); *H01R 13/521* (2013.01)

(58) Field of Classification Search
CPC ..... H01R 13/5205; H01R 13/521; H01R 14/405; H01R 13/5216
USPC ..... 439/271–276, 936, 279, 230, 736, 400, 439/76.1, 79
See application file for complete search history.

(56) References Cited

U.S. PATENT DOCUMENTS 5,518,427 A * 5/1996 Kan ..... H01R 13/521 439/276
6,655,975 B1 * 12/2003 Liedtke ..... H01R 13/5216 439/276
6,964,575 B1 * 11/2005 Sailor ..... H01R 13/5202 439/76.1
7,494,364 B2 * 2/2009 Sakamoto ..... H01R 4/2429 439/395
7,497,724 B1 * 3/2009 Fong ..... H01R 4/023 439/497
7,708,593 B1 * 5/2010 Gherardini ..... H01R 13/5216 439/604

* cited by examiner

*Primary Examiner* — Abdullah Riyami
*Assistant Examiner* — Harshad Patel
(74) *Attorney, Agent, or Firm* — Chun-Ming Shih; HDLS IPR Services

(57) ABSTRACT

A waterproof electric connector module includes an insulated housing, an electric connector, a blocking plate, and a sealed structure. The insulated housing is formed in an elongated shape. A front entry and a rear entry are individually formed on two end sides of the insulated housing and disposed aligned with each other. A side opening is formed on a side of the insulated housing and communicates with the rear entry. The electric connector is disposed in the insulated housing and has a plurality of terminals which extend and protrude from the side opening. The blocking plate blocks the rear entry. The sealed structure fills and seals the side opening. The terminals individually penetrate through the sealed structure. The waterproof housing can be sealed through the blocking plate and the sealed structure.

13 Claims, 6 Drawing Sheets

WATERPROOF ELECTRIC CONNECTOR MODULE AND ITS WATERPROOF HOUSING

BACKGROUND OF THE INVENTION

1. Field of the Invention

The present invention relates to an electric connector and, in particular, to a waterproof electric connector module and its waterproof housing.

2. Description of Related Art

With the booming popularity of mobile electronic devices, various electric connectors are widely applied in mobile electronic devices. To meet the waterproof requirement of the mobile electronic devices, various types of waterproof connectors are produced accordingly.

The design idea of waterproof connector is to prevent water from infiltrating into the mobile electronic device through the connector itself or the gap between the connector and the outer housing of the mobile electronic device. In a general design, a waterproof washer is disposed between the plug-in hole of the connector and the orifice of the outer housing of the mobile electronic device such that water can be effectively blocked into the mobile electronic device through the gap between the connector and the mobile electronic device. However, the connector itself comprises an insulated seat sleeved to the iron housing thereof and the terminals of the connector have to be soldered on the PCB inside the mobile electronic device. In general, a waterproof washer is clamped between the iron housing and the insulated seat, but the structure at the interface between the iron housing and the insulated seat is complex so the waterproof effect is not easy to be achieved. Therefore, a better waterproof effect can be achieved if the whole connector is covered. However, because the terminals mainly protrude from the side of the connector and are exposed for soldering, a waterproof structure of covering the whole connector is not easy to be implemented and assembled.

In view of foregoing, the inventor pays special attention to the above existing technology and researches with the application of related theory to overcome the above disadvantages regarding the above related art, which becomes the goal of the inventor's improvement.

SUMMARY OF THE INVENTION

The present invention is to provide a waterproof electric connector module and its waterproof housing.

The present invention provides a waterproof housing for receiving an electric connector. The waterproof housing comprises an insulated housing, a blocking plate, and a sealed structure. The insulated housing is for receiving the electric connector and is formed in an elongated shape. A front entry and a rear entry are individually formed on two end sides of the insulated housing and disposed aligned with each other. A side opening is formed on a side of the insulated housing and communicates with the rear entry. The blocking plate blocks the rear entry. The sealed structure fills and seals the side opening.

Preferably, a recess is formed at an inner edge of the rear entry and has a shape corresponding to an outer edge of the blocking plate which is inserted in the recess and blocks the rear entry. A waterproof ring is disposed around an outer edge of the front entry. The sealed structure seals a side of the blocking plate. The sealed structure is formed by curing a liquid plastic material which can be silicone or rubber.

The present invention also provides a waterproof electric connector module comprising an insulated housing, an electric connector, a blocking plate, and a sealed structure. The insulated housing is formed in an elongated shape. A front entry and a rear entry are individually formed on two end sides of the insulated housing and disposed aligned with each other. A side opening is formed on a side of the insulated housing and communicates with the rear entry. The electric connector is disposed in the insulated housing and has a plurality of terminals which extend and protrude from the side opening. The blocking plate blocks the rear entry. The sealed structure fills and seals the side opening. Each of the plurality of the terminals penetrates through the sealed structure.

Preferably, a recess is formed at an inner edge of the rear entry and has a shape corresponding to an outer edge of the blocking plate which is inserted in the recess and blocks the rear entry. A waterproof ring is disposed around an outer edge of the front entry. The sealed structure seals a side of the blocking plate. The sealed structure is formed by curing a liquid plastic material which can be silicone or rubber. A fastener is sleeved to the side of the insulated housing. The fastener extends a solder foot toward the direction of the terminals protruding from the side opening. The side of the insulated housing is provided with a recess in which the fastener is embedded. A hook is protruded from the recess. The fastener is provided with a snap hole snapped corresponding to the hook. The electric connector comprises an insulated seat which extends a tongue plate disposed corresponding to the front entry. The terminals are buried in the insulated seat. Each of the terminals has a soldering end protruding from the side opening and a lap end exposed on the tongue plate. The lap ends are arranged identically on two sides of the tongue plate.

The electric connection in the waterproof electric connector module of the present invention can be placed in the waterproof housing through the rear entry and the terminals can be placed in the side opening through the rear entry. Also, the waterproof housing can be sealed through the blocking plate and the sealed structure to cover the electric connector therein.

DETAILED DESCRIPTION OF THE INVENTION

Figure 1:
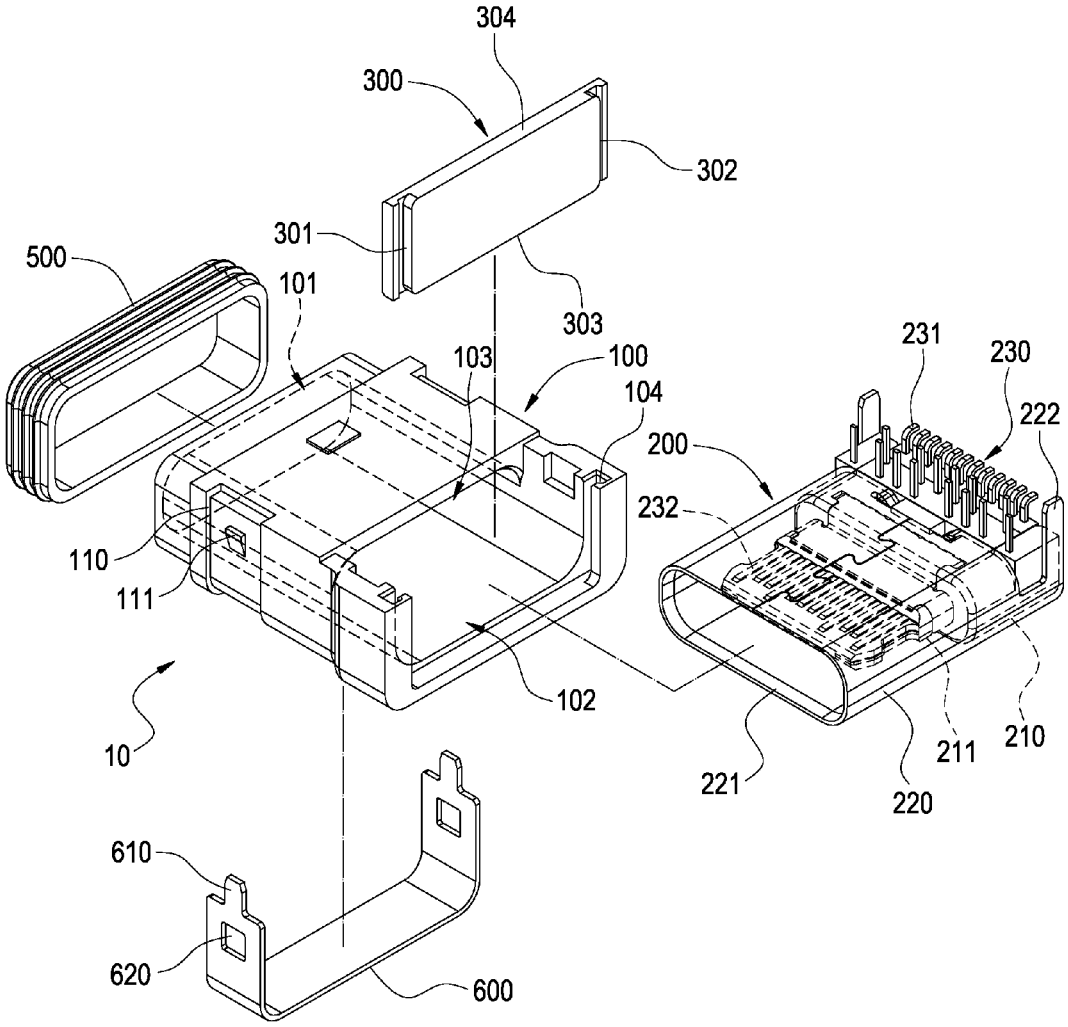
FIG. 1 is a perspective exploded schematic view of the waterproof electric connector module according to a preferred embodiment of the present invention.
Figure 2:
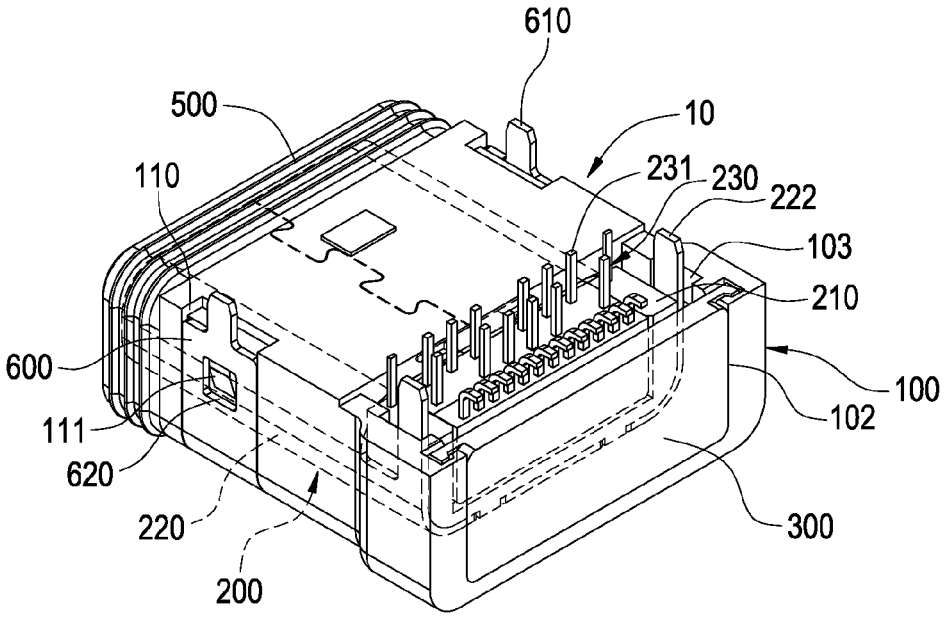
FIG. 2 is a perspective schematic view of the waterproof electric connector module according to a preferred embodiment of the present invention.

Referring to FIGS. 1-4, a preferred embodiment of the present invention provides a waterproof electric connector module comprising an insulated housing 100, an electric connector 200, a waterproof ring 500, and a fastener 600. In the current embodiment, the waterproof housing 10 comprises an insulated housing 100, a blocking plate 300, and a sealed structure 400.

In the current embodiment, the insulated housing 100 is preferably made by plastic injection molding and has a long cylindrical shape with a rectangular cross section. A front entry 101 and a rear entry 102 are individually formed on two end sides of the insulated housing 100 and disposed aligned with each other. A side opening 103 is formed on a side of the insulated housing 100 and communicates with the rear entry 102. An inner edge of the rear entry 102 has a U-like shape which corresponds to an outer edge of the blocking plate 300. In the current embodiment, a pair of sides at the inner edge of the rear entry 102 is provided with a pair of slots 104 correspondingly. The lip of the slot 104 preferably has an undercut shape. The side of the insulated housing 100 is provided with a recess 110 from which a hook 111 is protruded.

Figure 5:
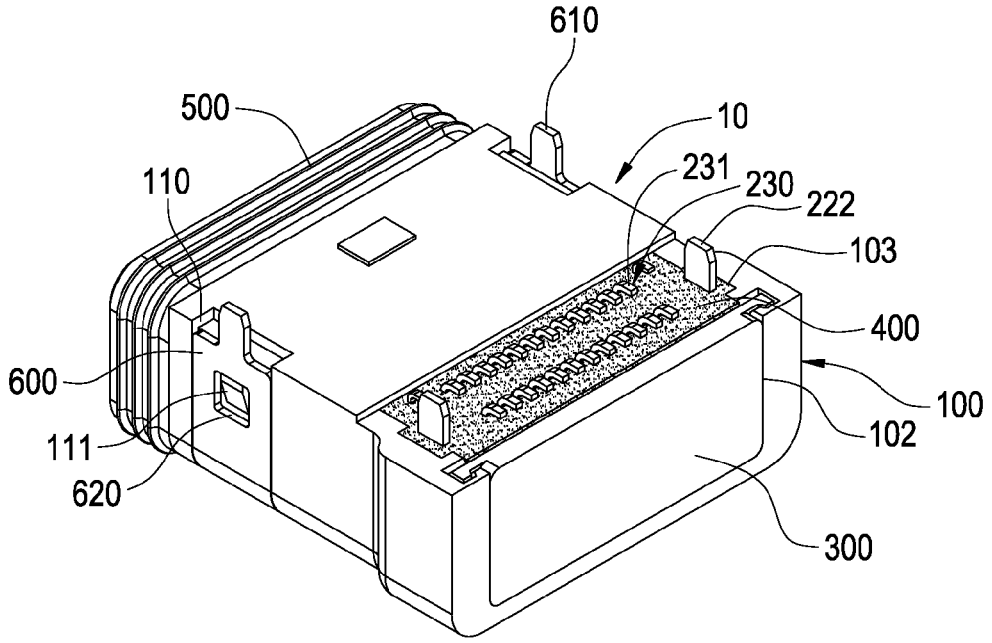
FIG. 5 is a schematic view of another variant of the waterproof electric connector module according to a preferred embodiment of the present invention.
Figure 6:
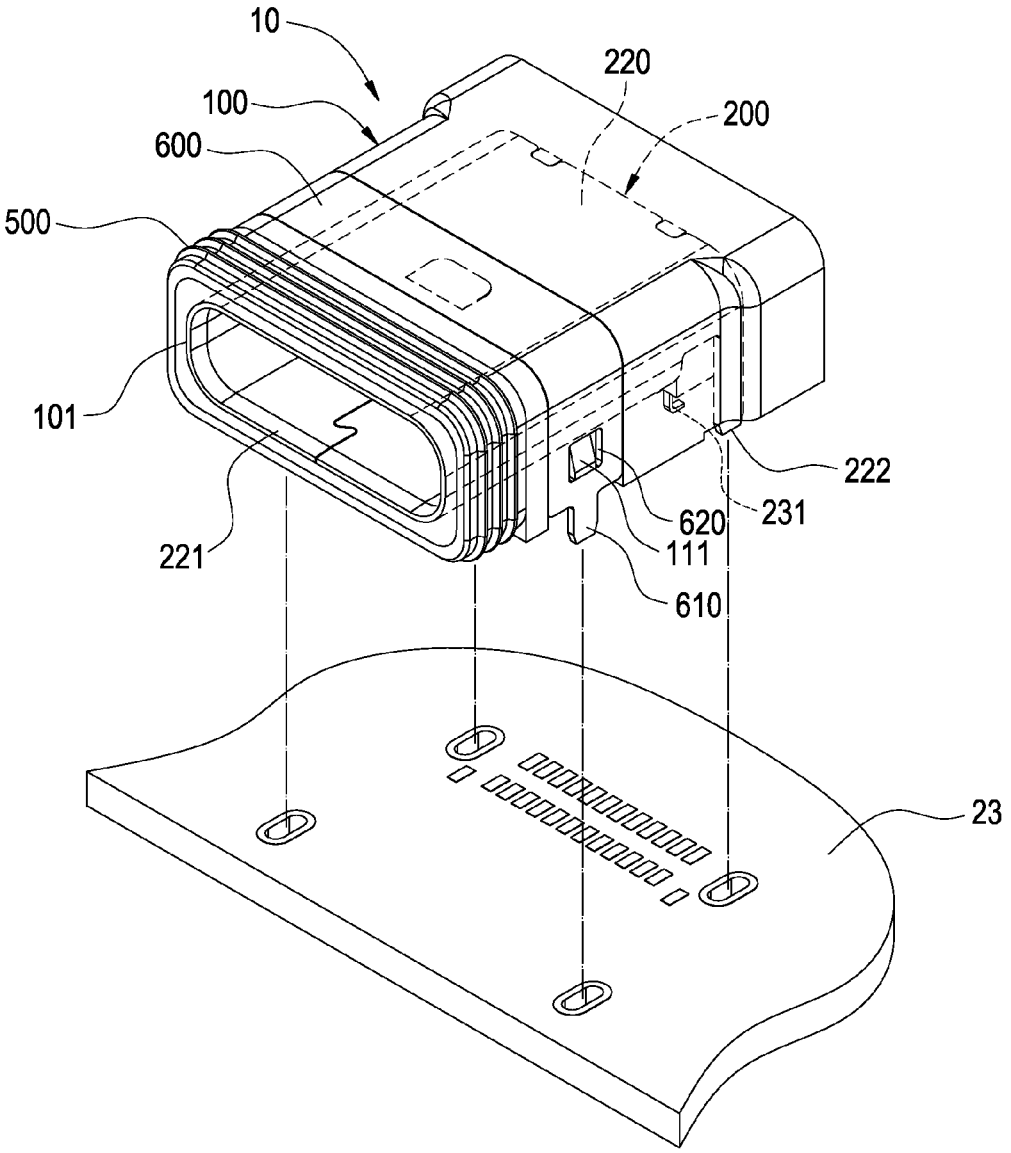
FIG. 6 is an installation view of another variant of the waterproof electric connector module according to a preferred embodiment of the present invention.

The electric connector 200 is received in the insulated housing 100 and comprises an insulated seat 210, a metal housing 220, and a plurality of terminals 230. The insulated seat 210 preferably extends to from a tongue plate 211 which has a plate shape. The metal housing 220 has a cylindrical shape with a rectangular cross section. An end of the metal housing 220 is sleeved out of the insulated seat 210; the end of the metal housing 220 extends to form a pair of solder feet 222 which extends and protrudes from the side opening 103. The other end of the metal housing 220 extends to form a plug-in hole 221 in which the tongue plate 211 is disposed. The plug-in hole 221 is preferably pressed against the inner edge of the front entry 101 of the insulated housing 100 such that the tongue plate 211 is disposed corresponding to the front entry 101 and the plug-in hole 221 connects the front entry 101 tightly. The terminals 230 are buried in the insulated seat 210. Each of the terminals 230 is formed by bending a long metal sheet and has a soldering end 231 and a lap end 232. The soldering end 231 penetrates out of the insulated seat 210 and further extends and protrudes from the side opening 103. The lap end 232 extends into the tongue plate 211 and is exposed on the surface of the tongue plate 211. Preferably, the extending direction of the solder foot 222 is the same as that of the soldering end 231 of the terminal 230 extending and protruding from the side opening 103, but the form and arrangement of the soldering end 231 are not limited in the present invention. For example, the soldering ends 231 can be arranged as shown in FIG. 5 or 6, and the extending direction of some of the soldering ends 231 is vertical to that of the solder feet 222. Preferably, the lap ends 232 are arranged identically on two sides of the tongue plate 211 and the arrangement of the lap ends 232 meets the specifications of USB 3.1 C-type.

In the current embodiment, the blocking plate 300 preferably is a rectangular plate. Three sides 301/302/303 of the edge of the blocking plate 300 connect to form a shape which corresponds to the U-like shaped inner edge of the rear entry 102. Also, the shapes of two sides 301/302 of the three sides 301/302/303 individually correspond to the slot 104. In this way, the blocking plate 300 is disposed inserted in the slot 104 and blocks the rear entry 102.

Figure 3:
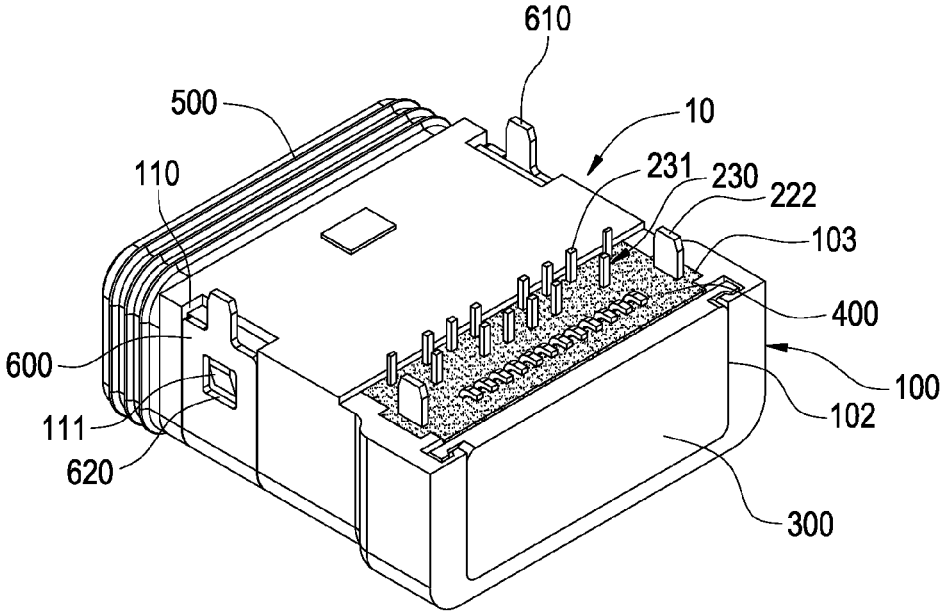
FIG. 3 is another perspective schematic view of the waterproof electric connector module according to a preferred embodiment of the present invention.
Figure 7:
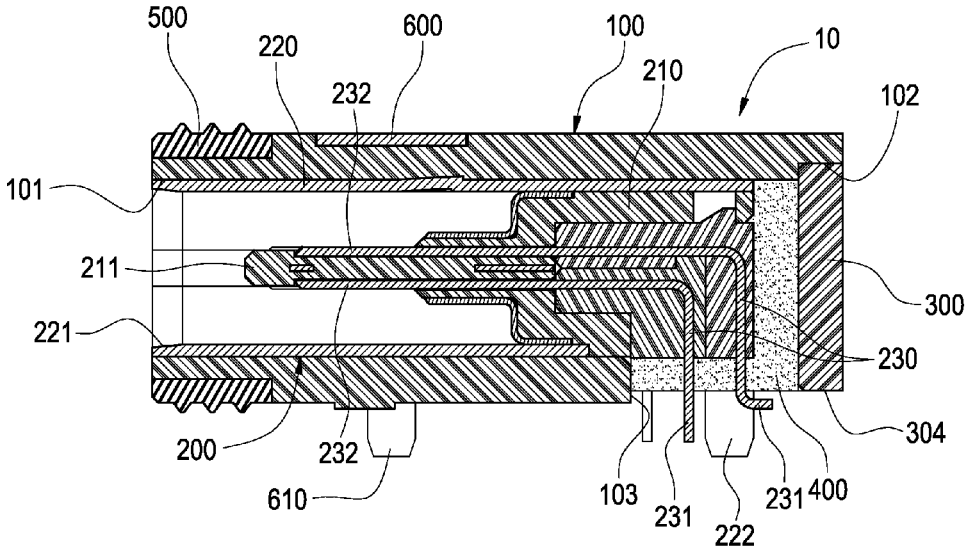
FIG. 7 is a cross-sectional view of the waterproof electric connector module according to a preferred embodiment of the present invention.

Referring to FIGS. 3 and 7, in the current embodiment, the sealed structure 400 is formed by curing a liquid plastic material which preferably can be silicone or rubber, but not limited to this. The liquid plastic material is filled in the space surrounded by the inner edge of the side opening 103 and the left side 304 of the blocking plate 300 such that the side opening 103 is sealed. Besides, the liquid plastic material covers the root of the soldering end 231 of each of the terminals 230 and the root of each of the solder feet 222. After the liquid plastic material is cured to form the sealed structure 400, the soldering end 231 of each of the terminals 230 and each of the solder feet 222 of the metal housing 220 individually extend to penetrate the sealed structure 400 and protrude from the side opening 103.

The electric connector 200 can pass through the rear entry 102 to be placed in the insulated housing 100; the terminals 230 can pass through the rear entry 102 to be placed in the side opening 103. Then, after the rear entry 102 and the side opening 103 are blocked by the blocking plate 300 and the sealed structure 400, the insulated housing 100 can be blocked and the electric connector 200 is covered in the insulated housing 100.

Figure 4:
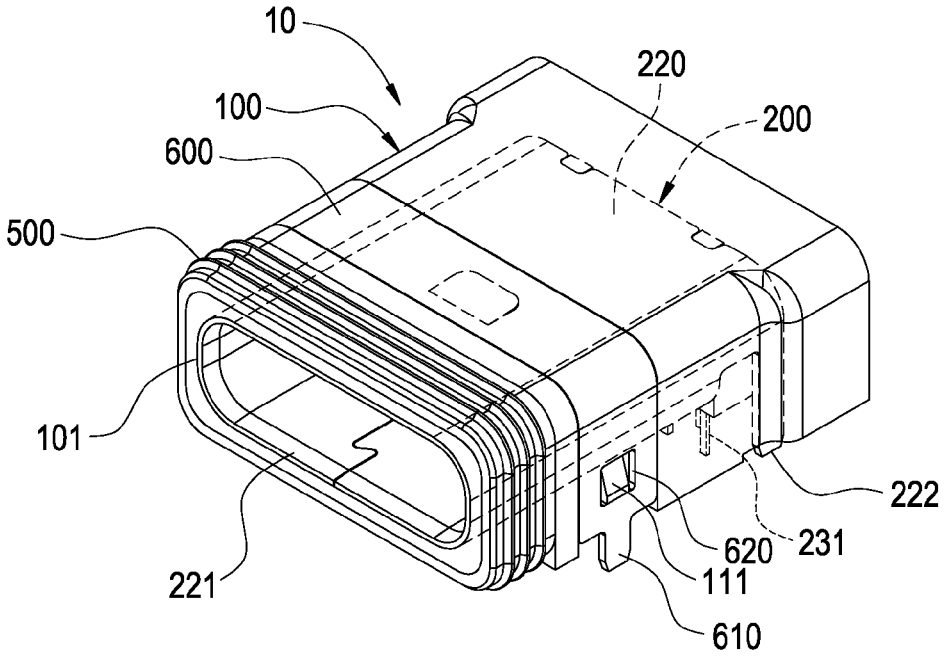
FIG. 4 is yet another perspective schematic view of the waterproof electric connector module according to a preferred embodiment of the present invention.

Please refer to FIGS. 4 and 7. The waterproof ring 500 is flexible and disposed around an outer edge of the front entry 101. In the current embodiment, the waterproof ring 500 can be made of silicone or rubber, but not limited to this.

Figure 8:
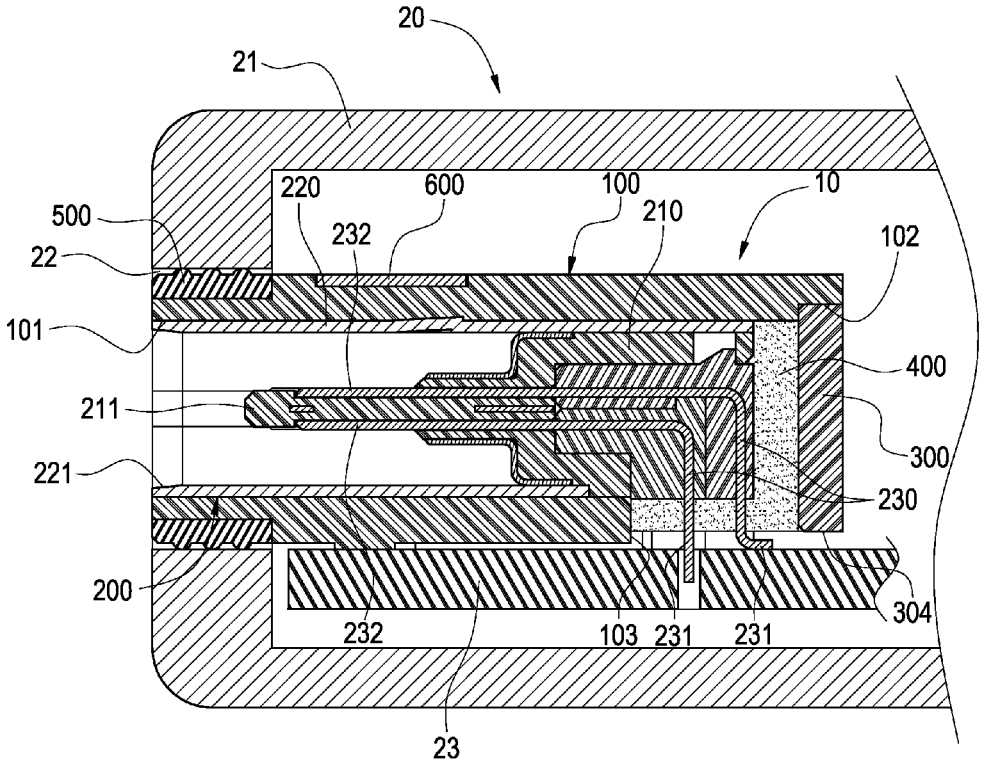
FIG. 8 is an installation view of the waterproof electric connector module according to a preferred embodiment of the present invention.

Please refer to FIG. 8. The waterproof electric connector module of the present invention is generally disposed in an electronic device 20. The electronic device 20 has a PCB 23 therein and the outer housing 21 of the electronic device 20 is provided with an orifice 22. The plug-in hole 221 of the electric connector 200 is disposed corresponding to the orifice 22 for plug-in. The soldering end 231 of each of the terminals 230 is individually welded to the PCB 23 and electrically connected to the PCB 23. Each of the solder feet 222 of the metal housing 220 is individually welded to the PCB 23 such that the electric connector 200 is fixed to the PCB 23.

The waterproof ring 500 can be pressed against the inner edge of the orifice 22 of the outer housing 21 of the electronic device 20. Thus, water can be prevented from infiltrating into the inner space of the electronic device 20 through the gap between the waterproof electric connector module and the inner edge of the orifice 22. Moreover, the waterproof electric connector module of the present invention can be isolated, between the electric connector 200 and the inner space of the electronic device 20, by means of its sealed structure 400 such that the outside water cannot infiltrate through the electric connector 200 into the inner space of the electronic device 20 to damage the PCB 23.

Figure 9:
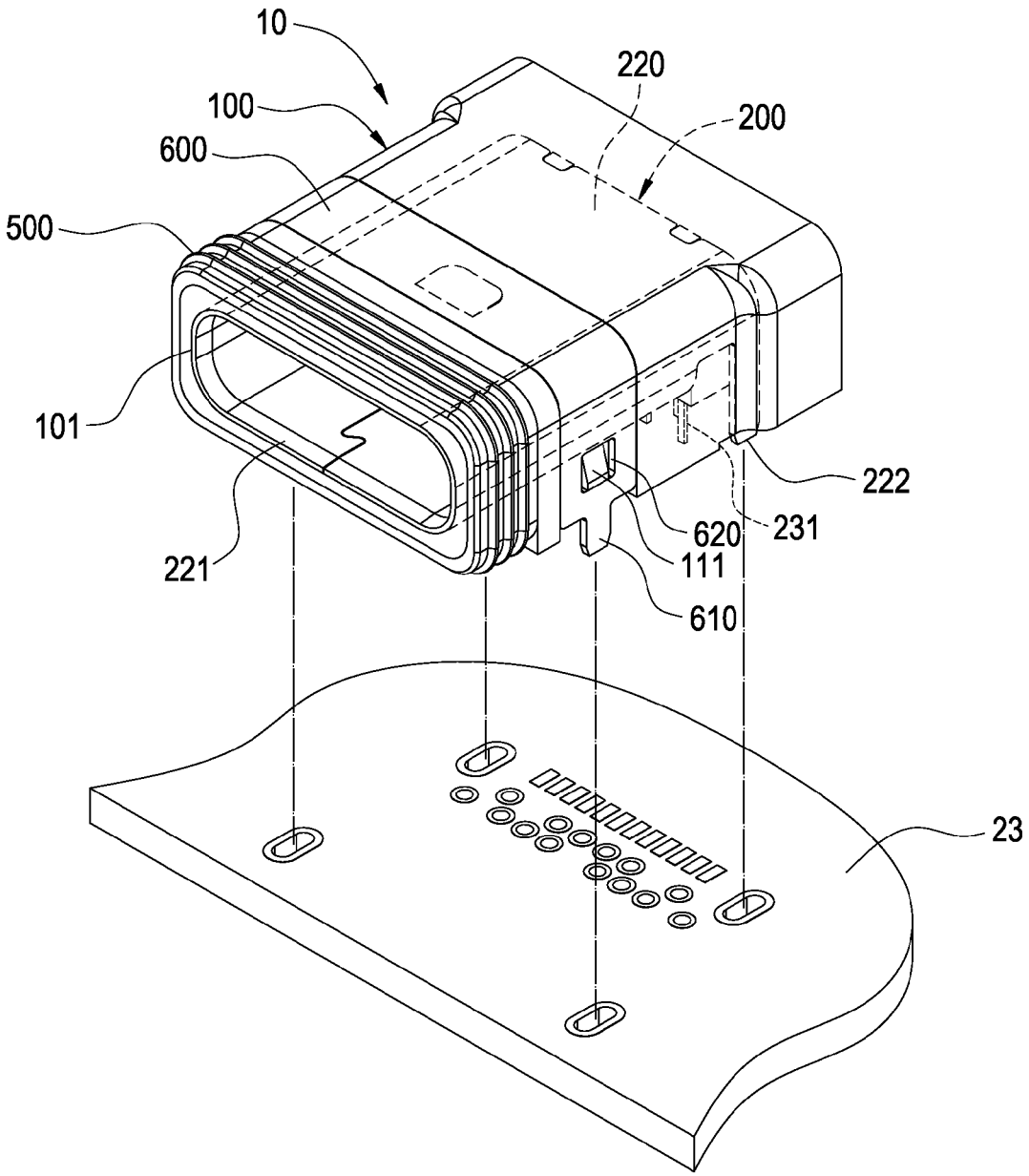
FIG. 9 is another installation view of the waterproof electric connector module according to a preferred embodiment of the present invention.

Please refer to FIG. 9. The fastener 600 is formed by bending a long metal sheet and has a U-like shape, which is sleeved to the side of the insulated housing 100 and embedded in the recess 110 of the insulated housing 100. The fastener 600 is provided with a snap hole 620 snapped corresponding to the hook 111 in the recess 110. In this way, the fastener 600 is fixed to the insulated housing 100. Two ends of the fastener 600 individually extend to form a solder foot 610. The extending direction of each solder foot 610 is toward the direction of the terminals 230 extending and protruding from the side opening 103 of the insulated housing 100. The solder feet 610 of the fastener 600 are individually welded to the PCB 23 to fix and connect the waterproof housing 10 to the PCB 23.

The embodiments described above are only preferred embodiments of the present invention, but not to limit the scope of the present invention. All the equivalent modifications based on the spirit of the present invention should be coved by the scope of the present invention.

What is claimed is:

1. A waterproof housing (10) for receiving an electric connector (200), the waterproof housing (10) comprising:

an insulated housing (100) for receiving the electric connector (200), wherein the insulated housing (100) is formed in an elongated shape, wherein a front entry (101) and a rear entry (102) are individually formed on two end sides of the insulated housing (100) and disposed aligned with each other, wherein a side opening (103) is formed on a side of the insulated housing (100) and communicates with the rear entry (102);

a blocking plate (300) blocking the rear entry (102);

a sealed structure (400) filling and sealing the side opening (103); and wherein a slot (104) is formed at an inner edge of the rear entry (102) and has a shape corresponding to an outer edge of the blocking plate (300) which is inserted in the slot (104) and blocks the rear entry (102).

2. The waterproof housing (10) according to claim 1, wherein the sealed structure (400) seals a side of the blocking plate (300).

3. The waterproof housing (10) according to claim 1, wherein the sealed structure (400) is formed by curing a liquid plastic material.

4. The waterproof housing (10) according to claim 3, wherein the liquid plastic material is silicone or rubber.

5. The waterproof housing (10) according to claim 1, wherein a waterproof ring (500) is disposed around an outer edge of the front entry (101).

6. A waterproof electric connector module, comprising:

an insulated housing (100) formed in an elongated shape, wherein a front entry (101) and a rear entry (102) are individually formed on two end sides of the insulated housing (100) and disposed aligned with each other, wherein a side opening (103) is formed on a side of the insulated housing (100) and communicates with the rear entry (102);

an electric connector (200) disposed in the insulated housing (100) and having a plurality of terminals (230) which are exposed out of the side opening (103);

a blocking plate (300) blocking the rear entry (102);

a sealed structure (400) filling and sealing the side opening (103), wherein each of the plurality of terminals (230) penetrates through the sealed structure (400); wherein a slot (104) is formed at an inner edge of the rear entry (102) and has a shape corresponding to an outer edge of the blocking plate (300) which is inserted in the slot (104) and blocks the rear entry (102); a fastener (600) sleeved to the side of the insulated housing (100), wherein the fastener (600) extends a solder foot (610) toward the direction of the terminals (230) extending and protruding from the side opening (103); and the side of the insulated housing (100) is provided with a recess (110) in which the fastener (600) is embedded, wherein a hook (111) is protruded from the recess (110), wherein the fastener (600) is embedded 5 in the recess (110) and is provided with a snap hole (620) snapped corresponding to the hook (111).

7. The waterproof electric connector module according to claim 6, wherein the sealed structure (400) seals a side of the blocking plate (300).

8. The waterproof electric connector module according to claim 6, wherein the sealed structure (400) is formed by curing a liquid plastic material.

9. The waterproof electric connector module according to claim 8, wherein the liquid plastic material is silicone or rubber.

10. The waterproof electric connector module according to claim 6, further comprising a waterproof ring (500) disposed around an outer edge of the front entry (101).

11. The waterproof electric connector module according to claim 6, wherein the fastener (600) is provided with a snap hole (620), wherein a hook (111) is protruded from the side of the insulated housing (100) and snapped corresponding to the snap hole (620).

12. The waterproof electric connector module according to claim 6, wherein the side of the insulated housing (100) is provided with a recess (110) in which the fastener (600) is embedded.

13. The waterproof electric connector module according to claim 6, wherein the electric connector (200) comprises an insulated seat (210) which extends a tongue plate (211) disposed corresponding to the front entry (101), wherein the terminals (230) are buried in the insulated seat (210), wherein each of the terminals (230) has a soldering end (231) protruding from the side opening (103) and a lap end (232) exposed on the tongue plate (211), wherein the lap ends (232) are arranged on two sides of the tongue plate (211).

* * * * *